United States Patent [19]

Lawson

[11] 3,978,547

[45] Sept. 7, 1976

[54] BRAKE HOUSING CLEANER

[76] Inventor: Las F. Lawson, 12737 Lavista Way, Poway, Calif. 92064

[22] Filed: Dec. 22, 1975

[21] Appl. No.: 643,150

[52] U.S. Cl. ..... 15/345; 15/405

[51] Int. Cl.[2] ..... A47L 5/14

[58] Field of Search ..... 15/304, 300, 314, 345, 15/346, 344, 405

[56] References Cited

UNITED STATES PATENTS

| | | | |
|---|---|---|---|
| 956,451 | 4/1910 | Thurman | 15/345 |
| 1,620,390 | 3/1927 | Peters | 15/314 X |
| 1,748,087 | 2/1930 | Spanel | 15/300 R X |
| 3,222,707 | 12/1965 | Allenbaugh | 15/345 |
| 3,510,905 | 5/1970 | Bannert | 15/345 |
| 3,731,340 | 5/1973 | Pitre, Sr. | 15/345 |

FOREIGN PATENTS OR APPLICATIONS

| | | | |
|---|---|---|---|
| 690,185 | 6/1930 | France | 15/346 |
| 10,796 | 5/1911 | United Kingdom | 15/345 |

*Primary Examiner*—Christopher K. Moore
*Attorney, Agent, or Firm*—Bruno J. Verbeck

[57] ABSTRACT

A brake housing cleaner that comprises a rigid curvilinear bonnet adapted to fit snugly over a brake housing, the bonnet which passes over the housing, the rim member being of an elastic material such as rubber, which is of a size and shape as to provide the snug fit over the housing. The bonnet is equipped with an opening connected by means of a hose to an air vacuum means. The wall of the bonnet is equipped with a plurality of apertures, each of which is provided with a rubbery material equipped with a self-closing lip through which an air nozzle can be inserted whereby to effect a resilient snug fit between the outside wall of the nozzle and the sides of the self-closing lip. In a partiularly preferred form of the invention, the said apertures are positioned substantially nearer the opening of the bonnet which passes over the brake housing than to the opening connecting the bonnet to the air vacuum means.

2 Claims, 3 Drawing Figures

BRAKE HOUSING CLEANER

BACKGROUND OF THE INVENTION

The removal of dust and other particles from brake drum assemblies is necessary in order to prevent wear and tear on the drums and linings, and as a safety measure. Ordinarily, in such a cleaning operation the wheel and the outer cover of the drum assembly are removed and a stream of air under pressure from a hose is directed against the various parts of the brake assembly to force dust and other particles therefrom. The dust contains ground-up brake lining material which is extremely high in asbestos. When such material is blown into the air from the brake assemblies, a substantial degree of air pollution occurs within the working area. Thus not only the mechanics working on the brakes but also anyone within, for example, fifty feet of the operator is subjected to breathing air that is contaminated with finely divided asbestos material. Furthermore the material which blown into the air clings to and coats almost anything in the working area such as light fixtures, water pipes, furniture, shelves, other vehicles, and floors, resulting in an expensive cleanup operation. In my initial efforts to solve the problem I first attempted to encase the entire brake assembly in a canvas bag and hook it up to a vacuum cleaner. Realizing that such bag structure would collapse under vacuum and be of no practical value I conceived of a device in the form of a bonnet formed of a durable plastic or light aluminum that would not collapse under vacuum, and subsequently tested and reduced to practice the device of the present invention.

I am aware that many efforts to minimize dust removal problems such as I have described above, involving various kinds of, apparatus and equipment for, that purpose, have been suggested, as for example the devices disclosed in U.S. Pat. Nos. 3,510,905 and 3,731,340. None of these to my knowledge are in commercial use. I believe that is due in part, to the fact that such devices are either expensive, hard to maintain, or not adaptable for use with the variety of brake drum assemblies that are encountered in every day operations in a repair shop.

SUMMARY OF THE INVENTION

A principal object of my invention therefore is to provide an apparatus that not only removes dust and other particles from brake drum assemblies in satisfactory manner and maintains the dust and particles in a confined area, but also which permits utilization with brake assemblies of various sizes and configurations, such as are frequently encountered in a busy brake repair shop.

A further object is to provide an apparatus which permits the removal of dust particles and the like from brake assemblies more simply and efficiently then heretofore.

Other objects and advantages of my invention will be made clear as the description of my invention proceeds.

In one embodiment of my invention I provide a bonnet which is adapted to fit snugly over a brake drum assembly. A flexible tube connects to an opening in the hood, and also to a vacuum creating device, for removing dirt particles and similar debris from the brake assembly which is covered over by the bonnet. Apertures in the wall of the hood, conveniently about one inch wide and two inches long are provided with a self-closing lip which is integrated into the cover over the aperture, and formed for example of sheet rubber which is ⅛ inch thick, and is glued or similarly secured to the inside wall of the hood around the circumference of the aperture. The flexible tube referred to can be conveniently 2½ inches in diameter. A satisfactory adhesive I have used both for the covers over the apertures as well as for securing a rim member, later described hereinafter, is Super Weather Strip adhesive, Pt No. 8001 manufactured by Minnesota Mining and Manufacturing of Minneapolis, Minnesota.

In using my device, the air hose, having a flexible nozzle thereon is inserted through the self closing lip, or slit, in one of the apertures and a blast of air directed against the brake assembly. A very satisfactory flexible nozzle is the button type nozzle manufactured by the Bridgeport Co., as No. 140 , it being a flexible nozzle ten inches long and formed of copper.

The foregoing procedure is repeated by inserting the air nozzle into the remaining apertures and directing air blasts against other areas of the brake assembly. Simultaneously, vacuum is being applied to the inside of the hood through the vacuum hose connected to a source of vacuum, such as the one available commercially as the Tornado with an external filter bag, RPM 2200 Model 180, 115 Volts, 9 AMPs, 1 horse power, manufactured by Breuer Electric Manufacturing Company of Chicago, Illinois.

The apertures in the wall of the bonnet can be varied in number, size and position; I have found that four such apertures are generally adequate. As to positioning of the apertures, I prefer to locate them close enough to the large open end of the —the end that moves over the brake assembly as the bonnet is being positioned thereover for cleaning —so that it is possible to maneuver the air nozzle so that its effect is directed behind any obstacles, such as flanges, which many brake assemblies have near the back plate.

My invention will be further understood in the course of the following detailed description taken in conjunction with the drawings, which describe and illustrate one embodiment of my invention.

DETAILED DESCRIPTION OF A PREFERRED EMBODIMENT

Figure 1:
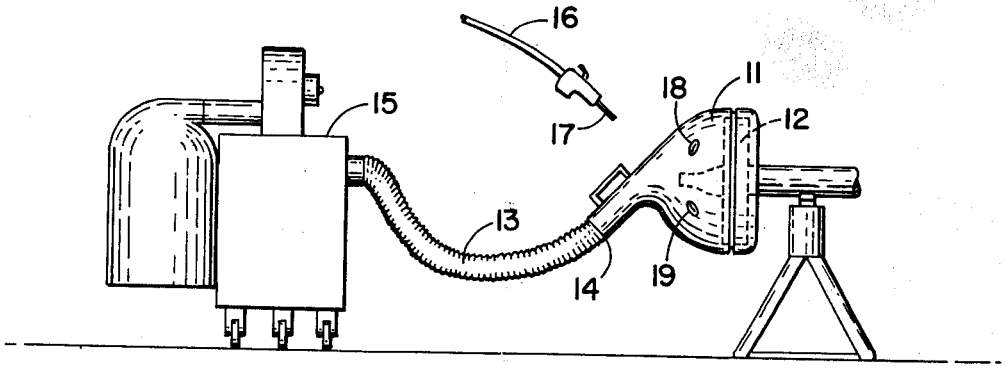
FIG. 1 is a view of the apparatus of my invention positioned on a brake housing and showing a vacuum means for removing dust from within the apparatus.

Referring to FIG. 1 a bonnet 11 of a rigid curvilinear construction preferably of plastic, aluminum, or the like, is shown positioned on a brake housing. A flexible tube 13 connects the smaller end of the bonnet 11 and a vacuum apparatus shown generally at 15. An air hose 16 equipped with a flexible nozzle 17 is adapted for insertion through aperture 18 or 19 or any other aperture (not showing) into the inside of the bonnet hood 11. With the bonnet mounted onto the brake housing assembly 12 as shown, the vacuum means 15 is turned on and the operator grasping the air hose 16 and the flexible nozzle 17 inserts the nozzle 17 through aperture 18 (and subsequently the other apertures) and by manual manipulation of the nozzle 17 directs an air stream onto parts of the housing which are covered within the bonnet 11.

The bits of dislodged dirt, ground-up asbestos from the drum linings, and the like are sucked into the vacuum apparatus 15 through flexible tubes 13, and the procedure is continued until the operation is completed.

Figure 2:
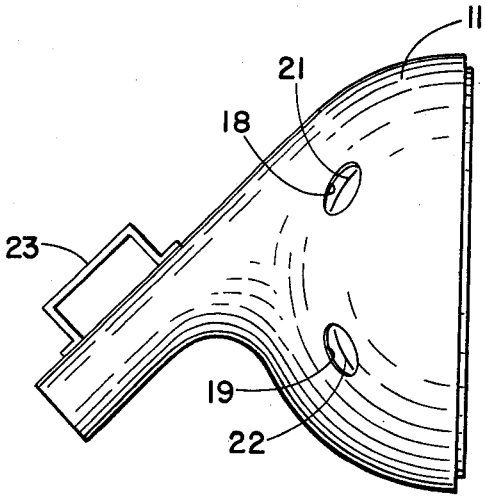
FIG. 2 is a side view of the apparatus of my invention showing the bonnet, two of the apertures and the split rubber seals, or self closing lips which are integrated with the aperture cover.

The bonnet 11, as best seen in FIG. 2 is made of any rigid material such as metal, plastic or the like, preferably aluminum and is generally of a semi-spherical or other curvilinear shape as shown. Apertures 18 and 19 which may be, for example, elliptical in shape, are covered with a self-closing lip 21 and 22 of flexible plastic or neoprene, the slit or lip 21 and 22 providing ingress for the flexible nozzle 17. A handle 23 permits ready movement and manipulation of the hood 11 on the brake housing which is to be cleaned.

Figure 3:
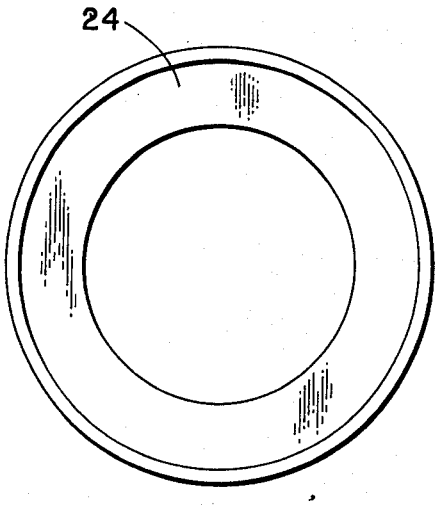
FIG. 3 is an end view of the bonnet shown in FIG. 2.

Referring to FIG. 3 there is shown a rim member 24 conveniently ⅛ inch thick of rubber or the like, which is firmly secured to the periphery of the hood 11 in a suitable manner, as with the aid of rubber cement or the like. I have found 3 M Trim cement, by 3 M of Minnesota Mining and Manufacturing Co., of Minneapolis, Minnesota, very satisfactory. The rim member

24 is sufficiently flexible so as to permit insertion of the hood 11 over the assembly to be cleaned while concurrently providing a snug fit and seal.

While I have described a presently preferred embodiment of my invention, it is to be understood that such description is for purposes of illustration and compliance with the statutory requirements, and is not to be limited except as required by the appended claims.

I claim:

1. A brake housing cleaner comprising a rigid, substantially curvilinear-shaped bonnet having a first opening adapted to fit snugly over a brake housing, said first opening being provided with a rim member of rubbery material extending inwardly and smaller than the circumference of said first opening, a second opening from the wall of the bonnet and defining a circumference adapted for connection to vacuum means, and a plurality of apertures in the wall of said hood, each of said apertures being provided with a cover of a rubbery material through which an air nozzle is insertable to effect a resiliently snug fit between the outside wall of said nozzle and said rubbery material.

2. The brake housing cleaner of claim 1 wherein at least some of said apertures are positioned nearer said first opening than said second opening.

* * * * *